United States Patent [19]

Compton

[11] 4,371,169

[45] Feb. 1, 1983

[54] IMAGINARY MULTI-LEVEL TICKTACKTOE

[76] Inventor: A. Berkeley Compton, 3420 Windsor Ct., Pleasanton, Calif. 94566

[21] Appl. No.: 203,368

[22] Filed: Nov. 3, 1980

[51] Int. Cl.[3] ..... A63F 3/00

[52] U.S. Cl. ..... 273/271; 273/239; 273/285

[58] Field of Search ..... 273/241, 271, 284, 285, 273/286; 40/492; 46/30

[56] References Cited

U.S. PATENT DOCUMENTS

| | | | |
|---|---|---|---|
| 330,990 | 11/1885 | Lundstedt | 273/243 |
| 2,061,510 | 11/1936 | Drumpelmann | 46/30 |
| 2,313,473 | 3/1943 | Heacock et el. | 273/241 |
| 2,368,896 | 2/1945 | Stewart | 273/130 |
| 2,949,306 | 8/1960 | Gitelson et al. | 273/130 |
| 3,169,769 | 2/1965 | Cornish | 273/241 |
| 4,131,282 | 12/1978 | Boyer et al. | 273/271 |

FOREIGN PATENT DOCUMENTS

| | | | |
|---|---|---|---|
| 465570 | 9/1954 | Italy | 273/285 |
| 1368151 | 9/1974 | United Kingdom | 46/30 |

*Primary Examiner*—Anton O. Oeschsle
*Attorney, Agent, or Firm*—David Pressman

[57] ABSTRACT

A multi-level ticktacktoe game consists of a plurality of individual ticktacktoe game boards 30, 32, 34, associated in a planar array. The players take turns in making or selecting an individual square or location on any board; the winner is the first player to claim and prove that one of said player's selected locations on every board when the individual boards are stacked in a multi-level array (FIG. 1B). The number of associated boards may vary to provide variable levels of difficulty. The boards may have a permanent or integral attachment or association means 38 or may be associated by removable fasteners (FIGS. 2B–2D), hook and eyelet strip fasteners 44–50, magnetic means 52–54, or by a flexible web or hinge 56. The boards may be associated in a linear, circular (enclosing), or cruciform formation. Different levels of difficulty may be provided on the same boards by the provision of three, four, five, or more different but interspersed design matrices 58, 62, 64 for the respectively different levels of difficulty.

10 Claims, 13 Drawing Figures

IMAGINARY MULTI-LEVEL TICKTACKTOE

BACKGROUND—FIELD OF INVENTION

This invention relates to games, particularly, to a new ticktacktoe game.

BACKGROUND—DESCRIPTION OF PRIOR ART

Heretofore ticktacktoe was played on a board, generally having nine spaces arranged in three rows and three columns. Each player in turn placed a distinct piece or mark (X or O) on any space on the board. The winner was the first to place a row of marks on the board. Because of its simplicity and lack of substantial challenge, this game had limited appeal and interest to most adults.

More complex ticktacktoe games have been offered, but these involved complicated apparatus, complicated rules, yet still did not present a sufficient challenge once the game had been played a few times. In addition, prior games were used as a form of recreation only, so that playing such games, even for an extended period of time, did not substantially increase a player's mental abilities or skills, other than at the specific game played.

In psychology, it has long been recognized that the left side of the human brain has superior rational skills and thus is more useful for linear or logical thinking abilities, while the right side of the brain has superior spatial and noumenal skills and thus is useful in nonlinear areas, such as the arts, other forms of creativity, and intuitive skills. It has been suggested that most people, especially in the Western world, have overdeveloped left-brain abilities and underdeveloped right-brain abilities. However heretofore there has not been any workable way to increase right-brain abilities consistently. It would thus be desirable if a simple tool were available to develop and increase right-brain abilities and skills.

Accordingly several objects of the invention are to provide a new and more challenging game, to provide a game which can improve mental abilities as well as provide recreation, and to provide a means for readily, rapidly, and enjoyably increasing right-brain abilities. Further objects and advantages of the invention will become apparent from a consideration of the ensuing description thereof.

DRAWINGS

REFERENCE NUMERALS

Figure 1A:
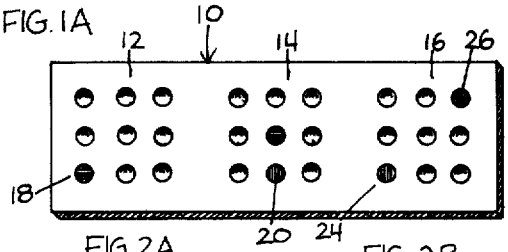
FIG. 1A is a plan view of an integral version of the game of the invention and FIG. 1B is a broken, multilevel view of the game of FIG. 1A.

10 gameboard
16 right section of 10
22 marble, blue
28 line
34 board, upper right
40 border area
46 eyelets
52 magnetic strip
58 square
12 left section of 10
18 marble, blue
24 marble, red
30 board, upper left
36 corner tab, left
42 attachment means
48 cloth
54 magnetic strip
60 playing piece
14 middle section of 10
20 marble, red
26 marble, blue
32 board, bottom
38 corner tab, right
44 cloth, right edge
50 hooks
56 flexible strip

FIG. 1—ONE-PIECE THREE-LEVEL GAME

FIG. 1 (A and B) shows an integral three-part, three-level or three-section version of the game of the invention. In FIG. 1A, game board 10 comprises an elongated, rectangular, substantially flat piece of wood, plastic, or cardboard having three sections, 12, 14, and 16. Each section has nine recesses arranged in three rows and three columns, with each recess being shaped and arranged to removably hold a playing piece, such as a marble, disc, or the like. Each group of recesses is separated from its adjacent group (or groups) by a greater separation than that between adjacent recesses within any group in order that the three groups may be distinguished. Alternatively, two vertical dividing lines (not shown) may be provided to separate the three sections. Board 10 may measure about 23 cm long, about 8 cm across, and may be about 1 cm thick.

The game is played with two players taking turns, each designating a recess or position on any of the three sections of board 10 during a turn by means of the placement of a colored marble (or other playing piece) in a recess. The winner of the game is the first player to designate three positions, one on each section of board 10, which can be interconnected by a straight line, assuming all three sections were stacked vertically. Unlike ordinary ticktacktoe, it does not count as a win if a player is able to interconnect three designated spaces on one section of the board by a straight line; to win the game a player must be able to pass a straight line through an imaginary stack of the three sections, 12, 14, and 16 of board 10, with the line intersecting a designated position in each section.

For example assume that the game is played between two players, one using red marbles and the other using blue marbles. Assuming that blue wins a preliminary draw, blue moves first by placing a marble 18 (lined for blue) in the bottom left position in section 12. Red then places a marble 20 (lined for red) in the middle position of section 14 of board 10. Blue then places a second marble 22 in the middle position of section 14. Red then places a marble 24 in the bottom left position of section 16, followed by blue placing a marble 26 in the top right position of section 16. Blue then claims a win because the three designated blue positions can be interconnected by a straight line through blue's designated positions in all three sections, assuming the sections were arranged in a vertical stack.

Figure 1B:
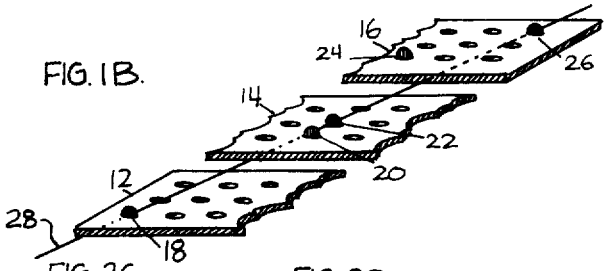

More particularly, reference is made to FIG. 1B where board 10 is shown broken into its three sections 12, 14, and 16, with these three sections arranged in a vertical stack (skewed for ease of illustration). Since an imaginary line 28 can be extended through blue's three designated marbles 18, 22, and 26 in all three sections, blue is the winner.

According to the rules of the game, if one side, e.g., blue, claims a win and it is determined that a straight line cannot be drawn through three of blue's designated positions on three separate sections of board 10 when arranged in a vertical stack, then the other side (red) will be declared the winner.

Because play of the game requires the players to imagine that the board is broken into three separate sections and arranged in a multilevel stack, the game has substantial challenge and complexity, especially as compared with ordinary ticktacktoe. Such a continuous call upon the imagination requires extensive use of and hence develops right-brain facilities. To ensure fairness and optimum use of right-brain facilities, the players are not allowed to construct or employ any multi-level stack of game board sections while playing the game.

FIG 2—SEPARATE BOARDS WITH CORNER TABS

Figure 2A:
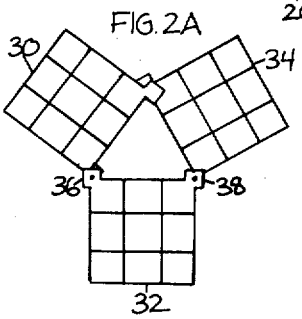
FIG. 2A is a plan view of a version of the game employing three boards with fastening tabs.

FIG. 1 illustrated the most basic and simplest version of the imaginary multi-level ticktacktoe game. The game can have increasing levels of difficulty and challenge by increasing the number of positions and levels and by varying the arrangement of the individual boards making up a game. In FIG. 2A, a three-level game similar to that of FIG. 1A is shown, but has substantially increased difficulty because it employs three separate boards, 30, 32, and 34, pivotably attached at their corners and arranged in an endless section to form an enclosing configuration. Thus imaginary spatial arrangement of these three boards in a multi-level stack is substantially more difficult than with the version of FIG. 1. The game is played similar to that of FIG. 1A, except that for win-checking purposes, the boards should be arranged in a linear configuration before being shifted (by imagination or physically) to a stack. Thus to arrange the boards in a linear configuration, board 32 should remain in the position indicated, and boards 30 and 34 should be rotated in opposite directions until they line up with board 32; thereafter the boards may be stacked in three levels with board 30 on the bottom, board 32 in the middle position, and board 34 at the top.

According to the invention, the individual boards are associated in a planar fashion and for this purpose any of various associating means may be employed.

In FIG. 2A, each board is provided with two corner tabs, 36 and 38, of a square configuration which extend from the corner of the board and have a hole therethrough for attachment to a tab of an adjacent board.

The tabs of adjacent boards may be attached by a paper rivet (FIG. 2B), a plastic barbed type fastener (FIG. 2C) which can be released by squeezing the barbs thereof together, or by a snap fastener (FIG. 2D) of the type used for cloth.

The three boards of FIG. 2A are shown with two tabs each for uniformity of manufacture, but in practice, only two fasteners will be employed (fastening boards 30 and 32 together and fastening boards 32 and 34 together as indicated in FIG. 2A) so that boards 30 and 34 may be conveniently swung down in alignment with board 32 at the end of the game for checking purposes.

The three boards in FIG. 2A are shown schematically as having nine squares arranged in three rows and three columns. The nine positions on each board may be recesses as in FIG. 1A or any other types of positions as indicated below. Since outward-extending tabs are employed, the squares can extend to the very edge of the board in order to optimize the size of the squares in relation to the size of the board.

FIG. 3—SEPARATE BOARDS WITH ATTACHMENT BORDERS

Figure 2B:
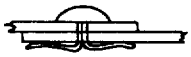
FIGS. 2B, 2C, and 2D are partial side views of three alternative tab fastening arrangements for the boards of FIG. 2A.
Figure 2C:
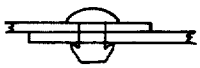
Figure 2D:
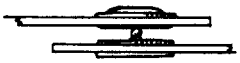
Figure 3:
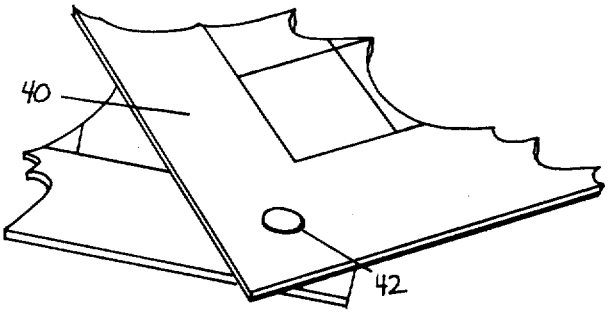
FIG. 3 is a partial isometric view of a version of the game employing multiple boards with border fastening areas.

In lieu of employing tabs as in FIG. 2A to associate adjacent boards, the board may be provided with a non-playable border area 40 as shown in FIG. 3 so that the attachment means 42 (of the types of FIG. 2B, 2C, or 2D) may be provided through holes in the corner of said border area without interfering with the playing positions of the board.

FIG. 4—SEPARATE BOARDS WITH VELCRO FASTENERS

Figure 4:
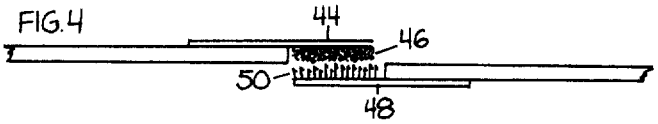
FIG. 4 is a partial side view of a game with a multiple hook/multiple eyelet fastening arrangement.

In lieu of the attachment means of FIGS. 2B, 2C, and 2D, adjacent boards may be attached by multiple-hook and multiple-eyelet type fastener means (sold under the trademark VELCRO), as indicated in FIG. 4. For this purpose boards with border areas as in FIG. 3 would be employed and a strip of cloth or rigid material 44 would be attached to a right edge of each board and multiple eyelets 46 provided on the underside of the extending portion of cloth 44. To the left edge of each board a similar strip of cloth 48 would be attached with multiple hooks 50 provided on the top side of the extending portion of cloth 48 for engagement with eyelets 46. The boards thus can be assembled and disassembled rapidly and repeatedly for storage or for win-checking.

FIG. 5—SEPARATE BOARDS WITH MAGNETIC FASTENERS

Figure 5:
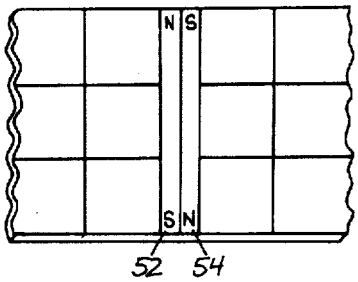
FIG. 5 is a plan view of part of a game with a magnetic fastening arrangement.

A magnetic attachment means for associating adjacent boards is shown in FIG. 5. In this arrangement a magnetic strip 52 (e.g., of rubberized ferrite) is attached to a right edge of each board and a mating edge 54 of rubberized ferrite of opposite polarity as indicated is attached to a left edge of the adjacent mating board. While strips 52 and 54 are shown as having their poles at the top and bottom, many other positions of these poles can be visualized and in lieu of two magnets, one on the edge of each board, only one magnet may be used and a strip of magnetically attractable material, such as iron, may be attached to the edge of the mating board.

FIG. 6—SEPARATE BOARDS WITH HINGE FASTENERS

Figure 6:
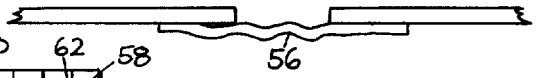
FIG. 6 is a partial side view of a flexible hinge fastening arrangement.

Still another board-to-board attachment method is shown in FIG. 6. In this embodiment a strip or hinge 56 of flexible plastic, cloth, etc. is interconnected between adjacent boards. Hinge 56 is made long enough so that the boards can be folded into a stack for storage. Strip 56 may be attached to each board by interlamination with adhesives, or other suitable means.

FIG. 7—BOARDS WITH MULTI-LEVEL CAPABILITY

Figure 7:
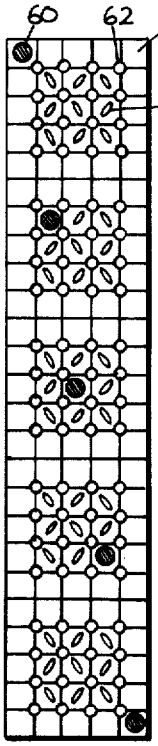
FIG. 7 is a plan schematic view of a five-section game in a linear arrangement.

For increased difficulty of play, the game can be provided with more than three, e.g., four, five, or more levels. FIG. 7 shows a schematic diagram of five game boards, associated in a linear array by any of the previously-discussed methods, with each board having three differently-sensible matrices, thus providing it with the capability of play on a three, four, or five-level basis, I.e., the top game board contains four horizontal and four vertical lines dividing the board into twenty-five squares, such as 58. Thus the board may be used with four other associated boards, as indicated in FIG. 7, for five-level play. A "win" is shown by five markers, such as 60, lined for green, which are shown in appropriate positions on the five boards such that a straight line can be drawn through all of markers 60 if the five boards were arranged in a vertical stack.

These boards also may be played on a four-level basis by utilizing the sixteen circles, such as 62, which are shown arranged in four rows and four columns, each circle lying at the junction of four of squares 58. To play the game on a four-level basis, the top board and three other boards would be arranged and associated in any of the ways previously shown and the players would mark or place playing pieces on the circles 62 until a win is achieved in the manner aforediscussed.

For beginners and decreased challenge of play, three boards may be played on a three-level basis by the use of ovals, such as 64, which are arranged in three rows and three columns to provide a nine-oval matrix. Each oval is positioned between four of circles 62 of the four-level matrix.

FIG. 8—ARRANGEMENT IN CIRCLE

Figure 8:
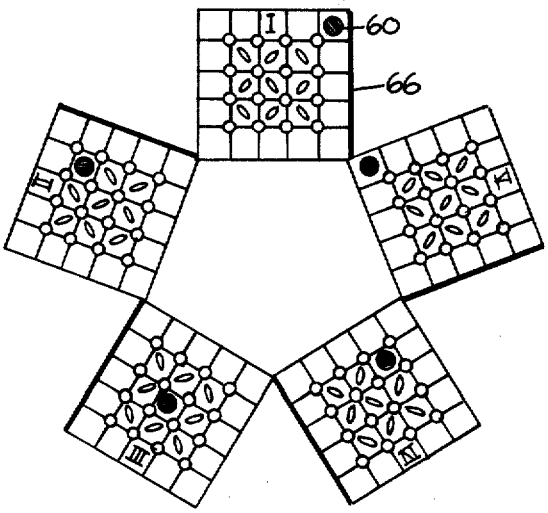
FIG. 8 is a plan schematic view of a five-section game with the boards arranged in an endless succession.

For still increased difficulty of play, the five (or less) boards may be arranged in an endless succession or circle to form an enclosing figure as illustrated in FIG. 8. The boards may be associated in the arrangement of FIG. 8 by any of the attachment methods aforediscussed.

When it is contemplated to use the board in other than the linear arrangement of FIG. 7, it is desirable to provide an orientation marker such as double line 66 (FIG. 8) at the left or other common edge of each board so as to resolve any ambiguity in how each board should be oriented when arranged in a stack. Also each board should bear a designation or level number to indicate its position in the stack. To this end the bottom middle square of each board has a Roman numeral (I to V) to indicate the board's intended position in the stack for win-checking purposes.

In lieu of a double line 66 and the Roman numeral on a board, various other means can be visualized. For example the left edge of each board can be printed with a color different than the rest of the board, a corner of the left edge of the board can be trimmed, the boards in the stack can have increasingly lighter colors from bottom to top, etc.

FIG. 9—CRUCIFORM CONFIGURATION

Figure 9:
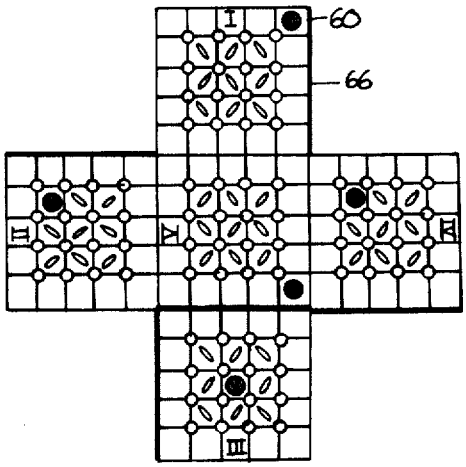
FIG. 9 is a plan schematic view of a five-section game with the boards in a cruciform arrangement.

FIG. 9 shows the boards arranged in a cruciform configuration for maximum difficulty of play. In this configuration the left edge of each board is designated by the double line 66 and the bottom of each board is designated by its level position in the stack. The first four boards are arranged in a circle, starting counterclockwise from the top with the bottom of each board facing outward. The fifth board is positioned in the center with its bottom to the left. However the boards can be scrambled to any other position.

While the above description contains many specificities these should not be construed as limitations upon the scope of the invention since many other ramifications will be apparent. For example in lieu of the physical boards shown, mechanical board systems or electronic board arrangements employing either a computer-driven cathode ray tube display or an electronically illuminable matrix, with automated win-checking circuitry may be provided. The integral (one piece) version of the game, as shown in FIG. 1A, can be provided on a larger surface, such as a placement, table, etc. The edge and board designating indicia in FIGS. 8 and 9 can be omitted for providing a version of still increased difficulty. In lieu of recesses or flat areas on the board's surface for holding round or flat playing pieces, respectively, the board's surface can have upstanding or vertically-projecting piece holders with flat or concave tops, such as golf tees mounted into the board, for providing a still more challenging and futuristic version of the game. The upstanding piece holders can even have different heights in respective sets of 25, 16, and 9, for respectively-different levels of difficulty, as discussed in connection with FIG. 7. Therefore the scope of the invention should be determined according to the appended claims and their legal equivalents.

I claim:

1. A tictactoe game comprising at least three tictactoe boards, each board comprising at least nine locations arranged in a common geometric pattern, each location comprising means for temporarily retaining a removable indication of either of two different types thereon, said boards each having a rectangular shape and being substantially planar, means attaching said boards to form a substantially planar array such that at least one of said boards is contiguous to the other two, said means comprising pivotable attachment means at at least two respective corners of said one board and at at least one corner of each of said other two boards for attaching said boards such that they can be rotated with respect to each other in a plane parallel to their planarity.

2. The game of claim 1 wherein said boards are associated in an endless succession so as to form an enclosing configuration.

3. The game of claim 1 wherein said boards are five in number, each board having twenty-five of said locations thereon arranged in a common predetermined geometrical pattern, and said five boards are rotatable into a single row such that each of at least three of said boards is contiguous to two others of said boards.

4. The game of claim 1 wherein said boards are five in number, each board having twenty-five of said locations thereon arranged in a common geometrical pattern, and said five boards are rotatable into an endless succession so as to form an enclosing configuration.

5. The game of claim 1 wherein said boards are five in number, each board having twenty-five of said locations thereon arranged in a common geometrical pattern, said five boards are rotatable into a cruciform arrangement such that one of said boards is contiguous to the other four thereof.

6. The game of claim 1 wherein each of said boards comprises at least sixteen of said locations arranged in a common geometrical pattern, said locations being of a first type having a common sensible parameter, and further including at least nine secondary locations thereon, said secondary locations being of a second type having a second common sensible paramenter different from said first common sensible parameter, said secondary locations being arranged in a similar common geometrical pattern and located within said first-named locations.

7. The game of claim 1 wherein each of said boards contains means thereon designating a common side of each board.

8. The game of claim 16 wherein each of said boards contains means thereon for designating said boards in a predetermined sequence.

9. The game of claim 1 wherein said means comprises at least two attachment tabs on two respective corners of each board and separable fastening means securing the tabs of adjacent boards together in overlapping fashion.

10. The game of claim 1 wherein each board has a margin around the edge thereof thereof surrounding said locations thereon, said means comprising fasteners for securing the margin areas of adjacent boards together in overlapping fashion.

* * * * *